US005242712A

United States Patent [19]

Miller

[11] Patent Number: 5,242,712

[45] Date of Patent: Sep. 7, 1993

[54] METHOD AND APPARATUS FOR MASKING A WINDOW IN A WINDOW FRAME TO BE SPRAY PAINTED

[76] Inventor: Walter K. Miller, 14666 24 Mile Rd., Shelby Township, Macomb County, Mich. 48315

[21] Appl. No.: 756,618

[22] Filed: Sep. 9, 1991

[51] Int. Cl.[5] ..... B05D 1/32

[52] U.S. Cl. ..... 427/282; 427/284; 118/505

[58] Field of Search ..... 427/259, 272, 282, 284; 118/505; 401/193

[56] References Cited

U.S. PATENT DOCUMENTS 2,082,791 6/1937 Copeman ..... 118/505

4,932,565 6/1990 Paradiso ..... 401/193

*Primary Examiner*—Shrive Beck

*Assistant Examiner*—Katherine A. Bareford

*Attorney, Agent, or Firm*—Remy J. VanOphem

[57] ABSTRACT

A method and apparatus for masking a window to facilitate spray painting of the window's frame. The method includes dispensing a temporary bonding agent along the entire perimeter of the window pane a predetermined distance from the window frame. The temporary bonding agent is used to temporarily adhere a suitable cover to the window pane, leaving only the window frame exposed. The temporary bonding agent is applied using a caulking gun. A caulking gun cartridge containing the temporary bonding agent is provided with an applicator nozzle having a nozzle opening which is spaced from an edge of the applicator nozzle the same distance as that desired for the placement of the bonding agent on the window pane. After masking the window pane with the cover, the window frame can be painted either by brush, or more preferably, by being sprayed with a conventional spray painter.

13 Claims, 1 Drawing Sheet

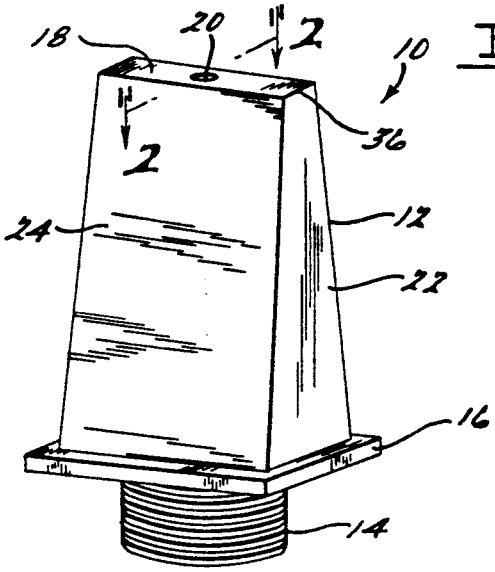
FIG. 1.
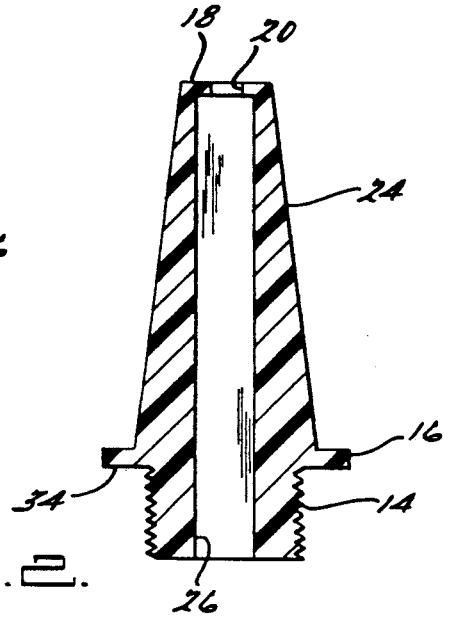
FIG. 2.
FIG. 3.
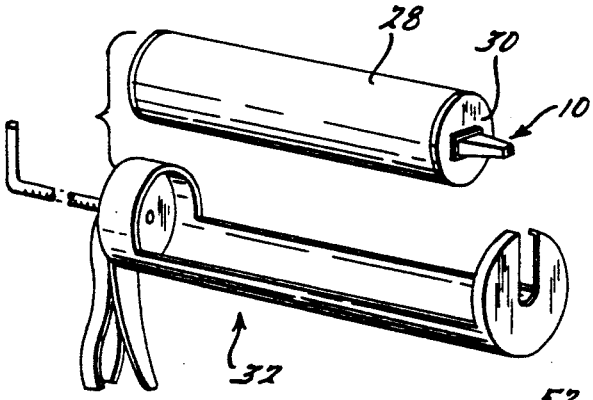
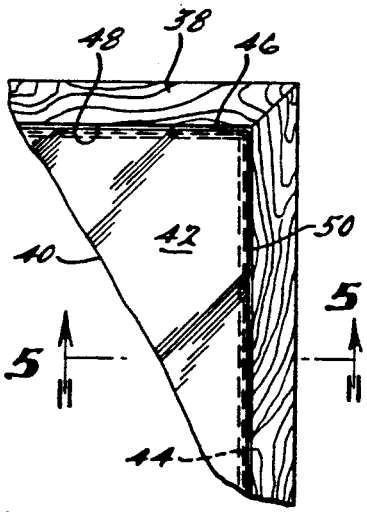
FIG. 4.
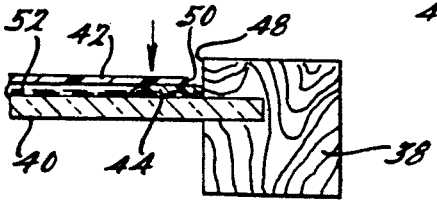
FIG. 6.
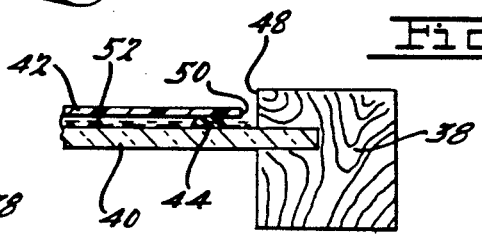
FIG. 5.

METHOD AND APPARATUS FOR MASKING A WINDOW IN A WINDOW FRAME TO BE SPRAY PAINTED

BACKGROUND OF THE INVENTION

1. Field of the Invention

The present invention generally relates to methods employed to facilitate the painting or finishing of window frames. More specifically, this invention relates to a method for masking a window in a window frame to be painted which employs an apparatus capable of accurately placing a temporary bonding agent between the window pane and a protective sheet which protects the window pane while the window frame is spray painted.

2. Description of the Prior Art

The necessity of painting window frames is a task that both painting contractors and homeowners alike find tedious and time-consuming. The primary reason for this is the desire to fully cover the window frame while at the same time avoiding getting the paint on the window pane itself. Paint which otherwise gets on the window pane must be thoroughly removed, particularly if the paint is oil-based. Particularly for a builder of new homes, removal can be time-consuming and cost intensive, at times requiring the use of a paint thinner. As a result, great care must be taken where the frame and the pane meet, generally necessitating a finer brush than normally used elsewhere.

When it is a paint contractor who is confronted with painting a window frame, time is a primary concern for purposes of cost-efficiency and competitiveness. The time needed to carefully paint around a window pane, multiplied by the number of windows to be painted, quickly adds up to a substantial amount of time lost for other jobs. In applications other than window frame painting, paint contractors are able to employ spray painting devices which greatly accelerate the process, making the contractor more cost-efficient and competitive with other contractors. However, for practical purposes window frames cannot be spray painted without providing some form of protection for the window pane. Traditionally, any advantage achieved in time by spray painting window frames has been offset by a considerable cost in time and money for additional work crews to remove the overspray from the window glass.

It is known in the art to mask the window pane by taping a paper covering over the window pane such that only the window frame is exposed. A paint sprayer can then be used to paint the window frame without getting paint on the window pane. However, a significant disadvantage to this method is that it is labor intensive and costly since it is time-consuming and difficult to remove the tape from the window pane once the paint has dried. Under most circumstances, the covering will be attached to the window pane well in advance of the actual time that the windows will be painted. Depending on the working environment, over time the tape may harden or become extremely tacky, thus making it very costly and difficult to remove the tape and its adhesive residue from the window pane. Again, paint contractors will find that any time and cost savings realized with spray painting will be offset by clean up costs.

Another disadvantage to the above method is that the use of a paper covering blocks the natural light coming in through the window, thus requiring artificial light sources to be used during the painting process. The use of a transparent cover, such as a thin sheet of plastic, with the above process is generally impractical because the plastic is more difficult to handle for one person alone, particularly while simultaneously trying to tape the plastic sheet to the window pane. Moreover, the tape tends to permanently adhere to the plastic sheet preventing reuse of the plastic sheet and producing excessive waste and costs to the contractor.

Therefore, it would be desirable to provide a method for masking a window by temporarily adhering a protective sheet to the window pane in which the sheet can be readily applied and removed by one person. Such a method would preferably employ the use of a temporary bonding agent as a substitute for the tape previously used. However, an applicator device would be needed which is able to accurately and quickly deposit the bonding agent relative to the window frame so as to securely bond the edge of the protective sheet along the window frame. In addition, it would be desirable to locate a predictable quantity of bonding agent such that the bonding agent would extrude out from beneath an undercut protective sheet and extend to cover the remaining exposed glass adjacent the window frame.

The prior art teaches various types of applicator devices for dispensing viscous fluids for numerous applications, including caulking compounds, lubricants and paints. Generally, the teachings of the prior art are primarily concerned with providing an applicator nozzle for controlling the flow of the viscous fluid to ensure that a sufficient quantity of the fluid is deposited on a surface in a way that is tailored to the specific geometric features of the surface. An example of this approach is U.S. Pat. No. 2,930,061 to O'Neil. O'Neil teaches a combined nozzle and spreader which conforms the flow of a lubricant to a cylindrical surface. In particular, the combination ensures that a thin film will be uniformly applied to the cylindrical surface for achieving thorough lubrication.

U.S. Pat. No. 4,957,225 to Childers and U.S. Pat. No. 4,946,081 to Jacobson are both directed to applicator nozzles for sealing compounds, such as caulk. Childers teaches a nozzle tip which is inclined with respect to the longitudinal axis of the nozzle. The purpose of the incline is to provide a nozzle tip which is self-wiping and which produces a smooth bead. Childers also employs a caulking-type gun which applies a predictable force to the cartridge containing the caulking compound, allowing a practiced user to anticipate the flow rate of the caulk. In contrast, Jacobson emphasizes the ability to provide a controlled flow rate of compound to the surface on which the compound is deposited by dispensing the compound through an auxiliary aperture which adjoins the primary aperture in the nozzle. The nozzle taught by Jacobson can therefore be directly abutted against the surface to which the caulk is applied and eliminates the influence on the flow rate due to the gap between the nozzle and the surface.

In a rather unconventional approach to controlling flow, U.S. Pat. No. 1,866,295 to Christman teaches a pumping unit which pumps paint through a nozzle for use in paint striping operations. The pump produces a metered flow which corresponds to the speed at which the nozzle is passed over the surface to be painted. The pump is driven by a large wheel which can be used as a guide to facilitate the formation of a straight paint stripe.

An applicator apparatus more related to window caulking is taught in U.S. Pat. No. 2,815,895 to Reed. Reed teaches a nozzle for dispensing window putty in the joints of a window frame or sash. Again, the emphasis is on controlling the quantity of the fluid dispensed. The nozzle is intended to be replaceable and has a predetermined orifice shape adapted to a specific application.

From the above discussion, it can be readily appreciated that the prior art does not disclose an applicator device which is adapted to accurately deposit a bonding agent a predetermined distance from a window frame for purposes of masking a window pane. In contrast, the prior art are each concerned with the particular quantity in which the viscous fluid is applied for purposes of appearance or uniformity. None of the references teach or suggest using an applicator nozzle having a geometry adapted for use as a guide when accurately applying a bonding agent adjacent the perimeter of a window pane. Nor are any of the prior art directed to the problems associated with depositing a protective coating on window frames.

Accordingly, what is needed is a method for masking a window pane which is time and cost-efficient, and which allows the window frame to take on a sprayed protective coating instead of being brushed. In order to fulfill this need, what is further needed is an applicator apparatus capable of accurately placing a suitable bonding agent on the window pane for masking the window pane in a manner that protects the window pane and yet leaves the window frame fully exposed.

SUMMARY OF THE INVENTION

According to the present invention there is provided a method for masking a window pane to facilitate the deposit of a protective coating on a window frame. The method includes dispensing a temporary bonding agent along the entire perimeter of the window pane a predetermined distance from the window frame. The temporary bonding agent is then used to temporarily adhere a suitable cover to the window pane, leaving only the window frame exposed.

The temporary bonding agent is applied with an applicator apparatus having a nozzle with a nozzle opening which is spaced a predetermined distance from an abutment surface on the nozzle. The distance by which the nozzle opening is spaced from the abutment surface is the same distance as that desired between the temporary bonding agent and the window frame. As the applicator apparatus is drawn across the surface of the window pane, the nozzle's abutment surface slides along the window frame to deposit the temporary bonding agent the desired distance from the window frame. The temporary bonding agent can be readily dispensed from a conventional caulking gun loaded with a cartridge adapted to receive the applicator nozzle of the present invention.

After application of the bonding agent, a properly sized cover is then applied to the window pane so as to substantially mask the window pane while leaving the window frame exposed. The temporary bonding agent acts to secure the cover to the window pane, while also acting to further mask the window pane when forced toward the perimeter of the window pane as the cover is pressed against the window pane. Thereafter, a protective coating may be applied to the window frame either by pressure spray or by brush, or more preferably, by being sprayed with a conventional spray applicator. Spray painting the window frame greatly reduces the time required to paint the frame and, therefore, offers a significant advantage in conjunction with the masking method of the present invention. Alternatively, the window frame can be stained or varnished using the above steps.

The method can be modified by applying a film of water to the window pane prior to the step of applying the temporary bonding agent. The film of water acts to temporarily adhere the full surface of the cover to the window, a particular advantage where the operator is working alone and/or where the window frame to be painted is large. In addition, it is generally more expedient to measure the window pane to precut the cover to the interior dimensions of the window frame. In so doing, it is preferable to produce an undersized rather than oversized cover to prevent the cover from partially masking the window frame to be painted. As noted above, the temporary bonding agent, when dispensed in the proper amounts and at the proper location, will assist the cover in masking the perimeter of the window pane.

According to a preferred aspect of this invention, after the operator has painted the window frame, the cover and the temporary bonding agent can be readily removed from the window pane and subsequently disposed of or, alternatively, the cover can be saved for future use. Temporary bonding agents such as siliconized caulking compounds can be readily removed from both the cover and the window pane without undue effort. As a result, the necessary clean up effort to remove any paint overspray and a conventional adhesive such as masking tape is avoided by the method of the present invention. The present invention avoids overspray by its superior masking capability, while also employing a temporary adhesive which is readily removable from the window pane.

In addition, a significant advantage of the present invention is that the temporary bonding compound is compatible with the use of transparent cover materials such as plastic, which permits natural light to enter through the window while still fully masking the window pane for painting the window frame. The features of the present inventive method all promote expedience and efficiency of the window frame painting process while also promoting accurate coverage of the paint on the window frame. As a result, paint contractors can realize substantial savings of cost and time in that the method of the present invention greatly reduces the time required to both protectively coat a window frame and clean up the window pane, allowing the paint contractor to be more competitive.

Accordingly, it is an object of the present invention to provide a method for protectively coating a window frame which facilitates coverage of the window frame while avoiding the excessive costs associated with excessive clean-up of the window pane afterwards.

It is a further object of this invention that such a method employ a temporary bonding agent which is deposited on the window pane so as to secure a mask thereto, yet is readily removable from the window pane once the mask is no longer required.

It is still a further object of this invention that such temporary bonding agent be dispensed such that it is accurately located along the perimeter of the window pane to both secure the mask immediately adjacent the window frame and also to assist in masking the window pane where the coverage of the mask itself is inadequate.

It is another object of this invention that such a temporary bonding agent be dispensed with an applicator apparatus which is capable of accurately depositing the temporary bonding agent a predetermined distance from the perimeter of the window pane.

It is yet another object of this invention that such a temporary bonding agent be readily removable from both the mask and the window pane when desired.

It is still another object of this invention that such an applicator apparatus be adaptable for use with a conventional caulking gun which is capable of applying a force for dispensing the temporary bonding compound.

Other objects and advantages of this invention will be more apparent after a reading of the following detailed description taken in conjunction with the drawings provided.

BRIEF DESCRIPTION OF THE DRAWINGS

FIG. 1 is a perspective view of an applicator nozzle in accordance with a preferred embodiment of this invention;

FIG. 2 is a cross-sectional view of the applicator nozzle taken along lines 2—2 of FIG. 1;

FIG. 3 is a perspective view of the applicator nozzle of FIG. 1 attached to a cartridge for installation within a caulking gun in accordance with the preferred embodiment of this invention;

FIG. 4 is a partial frontal view of a window pane mounted in a window frame wherein a transparent cover has been applied to mask the window pane in accordance with the preferred embodiment of this invention;

FIG. 5 is a partial cross-sectional view of the window pane and frame combination of FIG. 4 taken along line 5—5 thereof; and FIG. 6 is a partial cross-sectional view similar to that of FIG. 5 after the transparent cover has been pressed against the window pane illustrating the temporary bonding agent assisting the transparent cover to mask the perimeter of the window pane.

DETAILED DESCRIPTION OF THE PREFERRED EMBODIMENT

The steps of the present invention primarily employ readily available materials which can be safely used in both a home environment and on a building construction site. Primarily, the method allows both the professional and the novice painter to mask a window pane with a minimum of effort and time, while also providing full coverage of the window pane so as to allow the use of a spray painting device. The desired result is a more time efficient masking and painting method which also has the advantage of minimizing the amount of clean up required.

The steps detailed below can best be followed with reference to FIGS. 4, 5 and 6, which provide a frontal view and two cross-sectional views, respectively, of a window pane and frame. In a preferred order of steps, the first step is to measure a window pane 40 exposed within a frame 38. Next, a transparent cover 42, such as a cellophane drop cloth typically found in hardware stores, is trimmed to fit the measurements of the window pane 40 within the frame 38. Alternatively, an opaque cover can be used. However a disadvantage with an opaque cover is that is prevents natural light from passing through the window pane 40 once it has been masked, thus necessitating artificial light.

When trimming the cover 42, it will be impossible for most practical purposes to perfectly match the size and shape of the window pane 40. Consequently, it is preferable to produce a slightly undersized cover rather than an oversized cover to avoid partially masking the frame 38 to be painted. In the preferred embodiment, the cover 42 is of sufficient size so that when applied to the window pane 40 there is no more than a one eighth of an inch gap between the edge 50 of the cover 42 and the edge 48 of the window frame 38. The significance of this gap will be further explained below.

Water is then applied to the window pane 40 in sufficient quantities to provide a thin film of water 52 on substantially the entire surface of the window pane 40. A temporary bonding agent 44 is then applied at a predetermined distance from the window frame 38 along the entire perimeter of the window pane 40. In practice, it has been found that it is preferable to provide a gap 46 of approximately one eighth inch between the temporary bonding agent 44 and the edge 48 of the window frame 38. This is particularly true where, as will be described in more detail below, a typical caulkin gun 32 (FIG. 3) is used to deposit the temporary bonding agent 44. The caulking gun 32 deposits a sufficient quantity of the temporary bonding agent 44 which, when the cover 42 is subsequently applied and pressed against the window pane 40, will extrude the temporary bonding agent 44 toward the window frame 38 without covering the window frame 38. Accordingly, where the cover 42 is undersized by one eighth of inch, as previously described, the temporary bonding agent 44 will act to supplement the coverage provided by the cover 42 by substantially filling this gap between the cover 42 and the edge 48 of the window frame.

A siliconized caulking compound has been found to work satisfactorily for purposes of the present invention. Such a compound possesses sufficient adhesive strength for the extended durations often needed to mask and paint a number of windows at a construction site. In addition, the effect of the silicon is to promote the ease of removing the temporary bonding agent 44 from the window pane 40 and the cover 42, and thus make for easier clean up. The siliconized caulking compound resists excessive hardening and does not break down or become tacky after extended periods of exposure to most anticipated harsh environments.

Following the application of the temporary bonding agent 44, the cover 42 is applied to the window pane 40 so as to substantially cover the window pane 40 while leaving the window frame 38 entirely exposed. The cover 42 is then pressed against the window pane 40 to secure the cover 42 with the temporary bonding agent 44 and the thin film of water 52. Generally, it is preferred that the cover 42 be first pressed against the center of the window pane 40 so as to adhere the cover 42 to the window pane 40 with the thin film of water 52. This allows the cover 42 to be moved on the surface of the window pane 40 to properly center the cover 42. FIG. 5 illustrates the relative positions of the cover 42, the temporary bonding agent 44, and the window frame 38 immediately following this step. It is also preferable at this time to work out any air bubbles trapped between the cover 42 and the window pane 40.

Once the cover 42 is centered relative to the window frame 38, the cover 42 can be pressed against the temporary bonding agent 44 along the cover's edge 50. As a result of this pressing step, the temporary bonding agent 44 is extruded up to the window frame 38 but does not cover the window frame 38, as shown in FIG. 6. Accordingly, the temporary bonding agent 44 supplements the coverage provided by the cover 42 by filling any gap between the edge 50 of the cover 42 and the edge 48 of the window frame 38. In addition, the cover 42 is thereby secured to the window pane 40 by the temporary bonding agent 44 in a manner which will withstand extended periods of typical outdoor temperatures and humidity without losing its temporary adhesive character.

The window frame 38 can then be painted or finished in any suitable manner, though the present invention is primarily directed toward the method of spray painting window frames. Any time thereafter, the cover 42 can be removed from the window pane 40. The temporary bonding agent 44 will tend to adhere to the window pane 40, but can be readily removed without the use of chemicals or a great deal of effort. Generally speaking, a rigid plastic scraper will be sufficient to remove the temporary bonding agent 44 from the window pane 40.

The method of the present invention is preferably carried out with the use of the caulking gun 32 shown in FIG. 3. The caulking gun 32 is adapted to hold a caulking cartridge 28 containing a caulking compound, such as the silicon caulking compound preferred as the temporary bonding agent 44. For purposes of the present invention, the caulking cartridge 28 must be equipped with a suitable applicator nozzle 10 which will apply the temporary bonding agent 44 the predetermined distance from the edge 48 of the window frame 38. The preferred applicator nozzle 10 of the present invention is illustrated in FIGS. 1 and 2.

The applicator nozzle 10 of the preferred embodiment has a nozzle portion 12 which extends from a base portion defined by a shoulder 16. The nozzle portion 12 is elongated and extends from the shoulder 16 along a longitudinal axis. As illustrated, the length of the nozzle portion 12 is approximately 3 inches; however, under most circumstances the length of the nozzle portion 12 can be varied without any adverse effects on the performance of the applicator nozzle 10. The elongated exterior surface of the nozzle portion 12 is formed by an opposing pair of converging side walls 24 and an opposing pair of tapered side walls 22. The orientation of the tapered side walls 22 and the converging side walls 24 provide the nozzle portion 12 with a substantially square cross section adjacent the shoulder 16 which gradually becomes more rectangular in a direction away from the shoulder 16. The nozzle portion 12 terminates at a distal wall 18 which is disposed perpendicular to the longitudinal axis of the nozzle portion 12. The distal wall 18 defines an edge 36 with one of the tapered side walls 22. It is this edge 36 and its adjoining tapered side wall 22 which form an abutment surface used to locate the temporary bonding agent 44 relative to the window frame 38.

A nozzle opening 20 is disposed in the distal wall 18 and is spaced a predetermined distance from the edge 36. In the preferred embodiment illustrated in FIG. 1, the distal wall 18 has a length which is greater than its width. As a result, the nozzle opening 20 is spaced from the converging side walls 24 a shorter distance than the predetermined distance between the nozzle opening 20 and the edge 36. As noted above, it has been found that an approximately one eighth inch gap 46 between the temporary bonding agent 44 and the window frame 38 performs satisfactorily in accordance with the method of the present invention. Accordingly, in the preferred embodiment the nozzle opening 20 is spaced approximately one eighth of an inch from the edge 36. However, the spacing of the nozzle opening 20 may vary, depending upon external circumstances such as the ambient temperature, the type of cover 42 used, and the skill of the user. Therefore, a predetermined distance of one eighth of an inch is for illustrative purposes in keeping with the requirements of the preferred embodiment as disclosed.

Oppositely extending from the shoulder 16 relative to the nozzle portion 12 is an externally-threaded cylindrical member 14. The threaded cylindrical member 14 is formed to threadably engage an internally-threaded opening (not shown) in an end wall 30 of the cartridge 28. The applicator nozzle 10 is threadably installed into the cartridge 28 until a lower surface 34 of the shoulder 16, shown in FIG. 2, abuts the end wall 30 of the cartridge 28. As also shown in FIG. 2, a longitudinal bore 26 extends through the nozzle portion 12 and the cylindrical member 14, placing the temporary bonding agent 44 within the cartridge 28 in fluidic communication with the nozzle opening 20.

Once the cartridge 28 is properly loaded in the caulking gun 32, the temporary bonding agent 44 within the cartridge 28 is subjected to an external force which the caulking gun 32 applies through a spring loaded plunger mechanism or any suitable equivalent thereof. The caulking gun 32 expels the temporary bonding agent 44 under the influence of this external force such that a user can learn to anticipate the flow rate of the temporary bonding agent 44. Once the cartridge 28 is emptied, a new cartridge 28 can be placed in the caulking gun 32 with a new applicator nozzle 10 or the old applicator nozzle 10 can be threadably removed from the first and reused.

A significant advantage of the applicator nozzle 10 described above is that the nozzle opening 20 is positioned a distance from the edge 36 which accurately determines the distance by which the temporary bonding agent 44 is deposited relative to the window frame 38 of the window pane 40. When the temporary bonding agent 44 is applied, the tapered side wall 22 corresponding to the edge 36 is placed against the edge 48 of the window frame 38 so as to accurately place the nozzle opening 20 from the window frame 38. The caulking gun 32 can then be maneuvered along the perimeter of the window pane 40 while keeping the tapered side wall 22 abutted against the window frame 38.

The applicator nozzle 10 of the present invention also aids an operator in depositing a desired quantity of the temporary bonding agent 44 on the window pane 40 through the use of the caulking gun 32. Caulking guns 32 conventionally available apply a steady force on the contents of the cartridge 28, thus providing the user with a steady flow rate which is independent from the amount of pressure applied to the trigger of the caulking gun 32. With practice, a user is readily able to determine the optimal speed at which to follow the window frame 38 in order to deposit the proper amount of temporary bonding agent 44. Preferably, the nozzle opening 20 is sized such that the flow rate is sufficiently low so as to allow the user to have better control of the quantity of temporary bonding agent 44 deposited by the caulking gun 32. In practice, a single nozzle opening 20 having a diameter of approximately 0.1 inches has been found to be adequate.

Under some circumstances, two nozzle openings 20 (not shown) may be desirable. By example, when the viscosity of the temporary bonding agent 44 is sufficiently low such that it tends to extrude onto the window frame 38 when the cover 42 is applied, two smaller nozzle openings 20 may be preferably. The smaller nozzle openings 20 will more precisely deposit smaller individual quantities of the temporary bonding agent 44, thus avoiding excessive quantities of the temporary bonding agent 44 from accumulating near the edge 50 of the cover. In such an embodiment, nozzle openings 20 having a diameter of approximately 0.6 inches have been found to perform adequately.

The nozzle openings 20 described above are merely disclosed as being suitable under most conditions. A preferred diameter for the nozzle opening 20 will also depend upon the skill of the user, the ambient temperature of the window pane 40, and other extraneous conditions beyond the control of the user. A minimal amount of experimentation will quickly indicate to one skilled in the art the optimal size and number of nozzle openings 20 needed for a particular application.

Another significant advantage of the present invention is that the method disclosed greatly facilitates the paintings or finishing of window frames 38, particularly in the construction environment where there are typically many window frames 38 to be painted. Where the interdependency of jobs on a construction site have a significant effect on the timing and completion of each individual job, being able to proceed gradually in steps can often promote efficiency. With the method of the present invention, the paint contractor can mask the window panes at the first opportunity after the windows have been put in place by the construction crew. The temporary bonding agent 44, such as the preferred siliconized caulking compound, resists the eventual hardening noted with the tape used previously, as well as the tendency to become tacky when exposed to high temperatures or sunlight. The paint contractor is then free to paint the window frames 38 when further completion of the building's construction permits.

Once the painting is completed, the temporary bonding agent 44 can be readily removed without the need for chemicals or excessive physical force. The use of siliconized caulking compounds such as the temporary bonding agent 44 promotes the ease by which the temporary bonding agent 44 can be removed from both the cover 42 and the window pane 40. Thus, the effort necessary for the masking, painting and clean-up entailed with the present invention is significantly less than that known previously. For a paint contractor, the present invention provides a substantial savings in labor, time and costs, allowing him or her to be more competitive while at the same time provide the customer with a superior product in less than the usual time.

While the invention has been described in terms of a preferred embodiment, it is apparent that other forms could be adopted by one skilled in the art. For example, other suitable temporary bonding agents are or will become available which possess the qualities desired for the present invention. Also, mechanical, hydraulic and pneumatic devices can be readily substituted for the caulking gun 32 disclosed. Accordingly, the scope of the invention is to be limited only by the following claims.

What is claimed is:

1. A method for masking a window pane, said method comprising the steps of:

applying a temporary bonding agent to said window pane a distance from a window frame along the perimeter thereof;

applying a cover to said temporary bonding agent so as to substantially cover said window pane while leaving said window frame exposed, said cover being secured to said window pane with said temporary bonding agent;

depositing a protective coating on said window frame; and removing said cover and said temporary bonding agent completely from said window pane.

2. The method of claim 1 wherein said step of applying said temporary bonding agent includes depositing said temporary bonding agent with an applicator apparatus having a nozzle opening located said distance from an abutment formed on said applicator apparatus, said abutment being slidably abutted against said window frame to space said nozzle opening from said window frame said distance during said step of applying said temporary bonding agent.

3. The method of Claim 1 wherein said step of applying said temporary bonding agent includes depositing said temporary bonding agent with a caulking cartridge having a nozzle and a nozzle opening formed in said nozzle, said nozzle opening being located said distance from an edge formed on said nozzle.

4. The method of claim 1 wherein said step of applying said temporary bonding agent results in said temporary bonding agent being deposited approximately one eighth of an inch from said window frame along the perimeter of said window pane.

5. The method of claim 1 further comprising the step of applying a film of water to said window pane prior to said step of applying said temporary bonding agent.

6. The method of claim 5 further comprising the step of pressing said cover against said film of water on said window pane so as to cohesively secure said cover to said window pane prior to applying said cover to said temporary bonding agent.

7. The method of claim 6 wherein said pressing step includes removing air bubbles between said cover and said window pane.

8. The method of claim 1 further comprising the steps of:

measuring said window pane prior to applying said temporary bonding agent; and cutting said cover prior to said step of applying said cover to said window pane such that said cover substantially corresponds in shape and size to said window pane.

9. The method of claim 1 further comprising the step of removing said cover and said temporary bonding agent from said window pane after said depositing step.

10. The method of claim 1 wherein said depositing step is a spray painting step.

11. A method for masking a window pane and painting a window frame disposed along a perimeter of said window pane, said method comprising the steps of:

measuring said window pane delineated within said window frame;

providing a transparent cover that substantially corresponds in shape and size to said window pane as delineated by said window frame;

applying a temporary bonding agent a distance from said window frame along said perimeter of said window pane;

applying said transparent cover to said window pane so as to substantially cover said window pane while leaving said window frame exposed;

pressing said transparent cover against a film of water between said transparent cover and said window pane and against said temporary bonding agent on said window pane so as to cohesively secure said transparent cover to said window pane, said transparent cover being secured to said window pane with said temporary bonding agent along a perimeter of said transparent cover;

painting said window frame; and removing said cover and said temporary bonding agent completely from said window pane.

12. The method of claim 11 wherein said step of applying said temporary bonding agent includes depositing said temporary bonding agent with an applicator apparatus having a nozzle opening located said distance from an abutment formed on said applicator apparatus, said abutment being slidably abutted against said window frame to space said nozzle opening from said window frame said distance during said step of applying said temporary bonding agent.

13. The method of claim 11 wherein said step of applying said temporary bonding agent includes depositing said temporary bonding agent a distance of approximately one eighth of an inch from said window frame along said perimeter of said window pane.

* * * * *

UNITED STATES PATENT AND TRADEMARK OFFICE

CERTIFICATE OF CORRECTION

PATENT NO. : 5,242,712
DATED : September 7, 1993
INVENTOR(S) : Walter K. Miller

It is certified that error appears in the above-indentified patent and that said Letters Patent is hereby corrected as shown below:

Column 6, line 24, delete "caulkin" insert ---- caulking ----.

Column 9, line 6, delete "preferably" insert ---- preferable ----.

Signed and Sealed this

Fifteenth Day of November, 1994

Bruce Lehman

*Attest:*

BRUCE LEHMAN

*Attesting Officer*

*Commissioner of Patents and Trademarks*